US005524868A

United States Patent [19]

Decker et al.

[11] Patent Number: 5,524,868

[45] Date of Patent: Jun. 11, 1996

[54] HYDRAULIC TOE JACK

[75] Inventors: Arnold F. Decker, Aurora; Timothy L. Silke, Woodridge, both of Ill.

[73] Assignee: Templeton, Kenly & Co., Inc., Broadview, Ill.

[21] Appl. No.: 112,441

[22] Filed: Aug. 26, 1993

[51] Int. Cl.[6] ..... B66F 3/24

[52] U.S. Cl. ..... 254/93 H

[58] Field of Search ..... 92/165 PR, 168 R, 92/165 R; 254/93 H, 93 R

[56] References Cited

U.S. PATENT DOCUMENTS

| | | | |
|---|---|---|---|
| 87,435 | 3/1869 | Ryan . | |
| 2,412,414 | 12/1946 | Mueller . | |
| 2,527,428 | 10/1950 | Kemerer . | |
| 2,654,568 | 10/1953 | Pine . | |
| 3,081,066 | 3/1963 | Murawski . | |
| 3,321,182 | 5/1967 | Elenburg . | |
| 3,334,773 | 8/1967 | Bimba | 92/165 R |
| 3,370,421 | 2/1968 | Piper . | |
| 3,601,011 | 8/1971 | Arnes | 92/168 |
| 3,622,124 | 11/1971 | Sidles et al. . | |
| 3,674,240 | 5/1972 | Larsson . | |
| 3,762,688 | 10/1973 | Leonhardt . | |
| 3,773,292 | 11/1973 | Thiermann . | |
| 3,782,689 | 1/1974 | Barosko . | |
| 3,805,933 | 4/1974 | Pray . | |
| 3,806,091 | 4/1974 | Wride . | |
| 4,021,018 | 5/1977 | Dasan . | |
| 4,119,017 | 10/1978 | Nusbaumer et al. . | |
| 4,174,095 | 11/1979 | Chipman . | |
| 4,270,733 | 6/1981 | DePue . | |
| 4,285,641 | 8/1981 | Brimhall . | |
| 4,357,798 | 11/1982 | Hung . | |
| 4,384,511 | 5/1983 | Mefferd | 92/168 |
| 4,406,215 | 9/1983 | Lacasse . | |
| 4,442,759 | 4/1984 | Elser | 92/165 P R |
| 4,443,001 | 4/1984 | Haerer . | |
| 4,445,666 | 5/1984 | McDermott . | |
| 4,480,529 | 11/1984 | Winkler et al. | 92/165 P R |
| 4,572,480 | 2/1986 | Heintzmann . | |
| 4,783,053 | 11/1988 | Yirmiyahu et al. . | |
| 4,852,862 | 8/1989 | Bauer et al. | 92/168 |
| 4,886,244 | 12/1989 | Renault . | |
| 4,896,584 | 1/1990 | Stoll et al. | 92/165 P R |
| 4,925,158 | 5/1990 | Yang . | |
| 5,000,424 | 3/1991 | Inoue . | |
| 5,048,794 | 9/1991 | Mamessier | 254/93 M |

FOREIGN PATENT DOCUMENTS

| | | | |
|---|---|---|---|
| 0346716 | 12/1989 | European Pat. Off. . | |
| 53-147176 | 12/1978 | Japan | F15B 15/14 |
| 1587367 | 5/1978 | United Kingdom . | |
| 2243873 | 11/1991 | United Kingdom . | |

OTHER PUBLICATIONS

Simplex Brochure, Hydraulic & Mechanical Jacks for Industry, pp. 6, 7, 33–37.

Templeton, Kenly & Co., Inc. Selection Guide, Railroad Jacking Equipment.

Simplex Rol–Toe Hydraulic Jack Repair Parts Sheet—Operating Instructions.

Simplex Center–Hole, Toe Lift & Two Speed Jacks, p. 7 (1 page).

Simplex Jacks: Track (or trip) Jacks, p. 12 (1 page).

Mattison Toe Jack Brochure (3 pages).

Hilman Jacks Brochure HJ91/2 (3 pages).

*Primary Examiner*—Robert C. Watson

*Attorney, Agent, or Firm*—Michael, Best & Friedrich

[57] ABSTRACT

The invention provides a hydraulic toe jack including a base adapted to be supported by the ground, an elongated piston extending from the base and defining an axis, a generally cylindrical toe housing having a closed end and an open end, the toe housing defining an inner surface surrounding a portion of the piston, the toe housing being movable along the axis relative to the piston, interengaging components on the inner surface and the piston for preventing rotation of the toe housing relative to the piston about the axis, and a seal sealingly fixed to the toe housing adjacent the open end of the toe housing and slidably sealingly engaged with the piston.

25 Claims, 6 Drawing Sheets

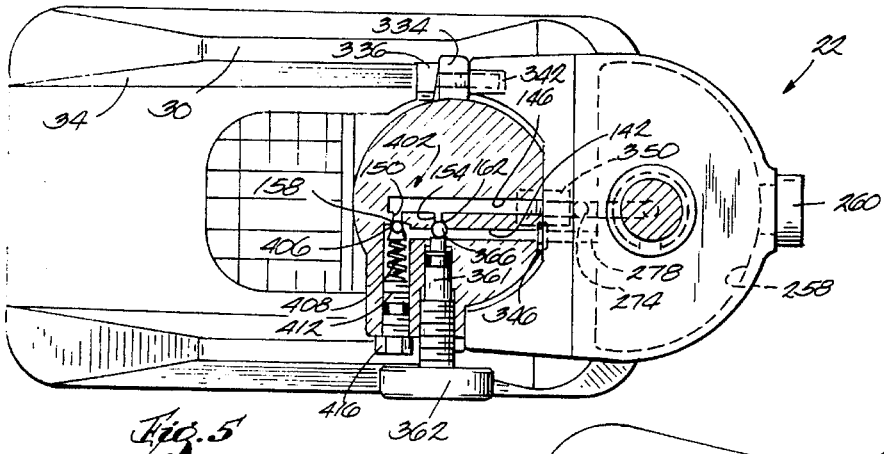
Fig. 5
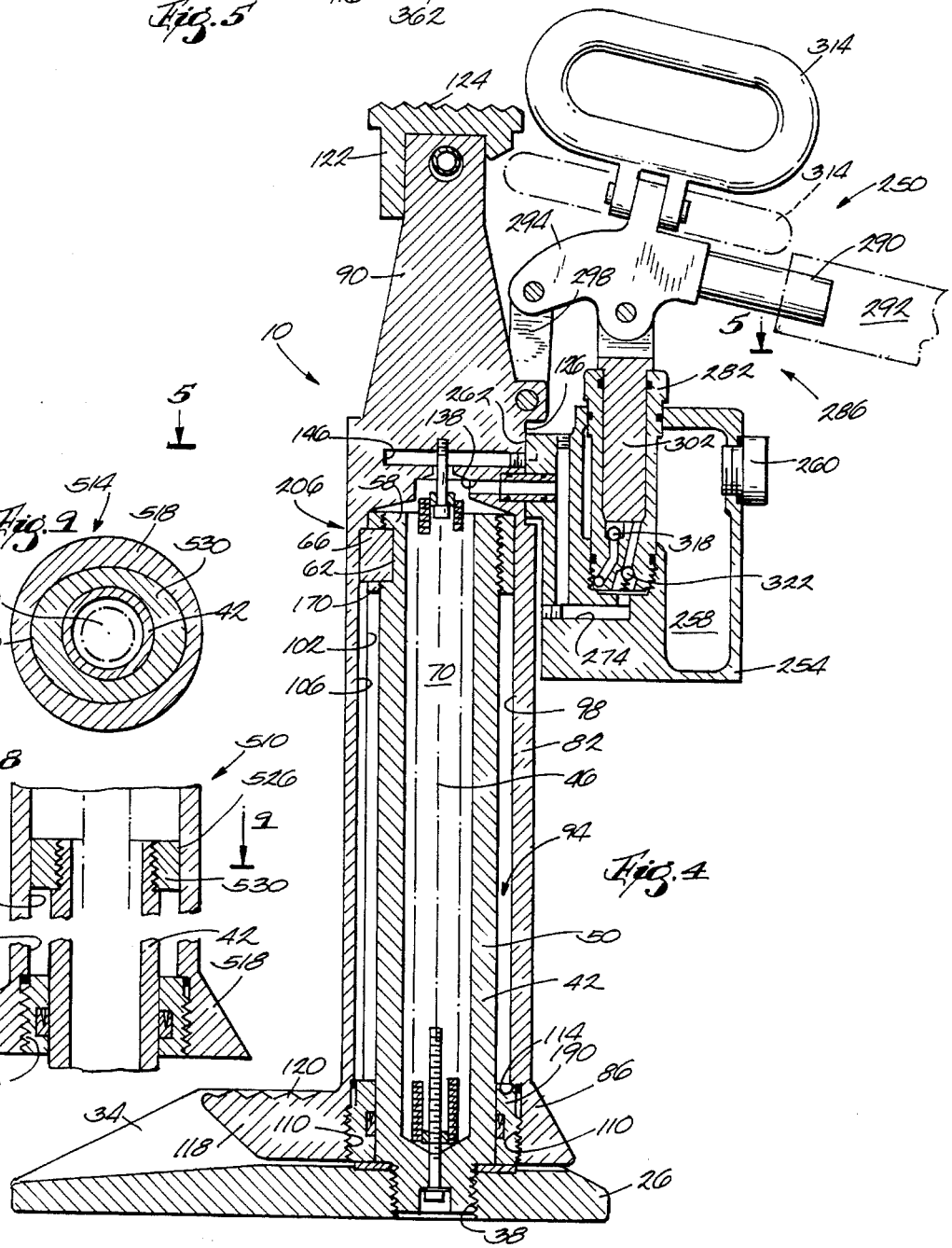
Fig. 9
Fig. 8
Fig. 4

Fig. 20
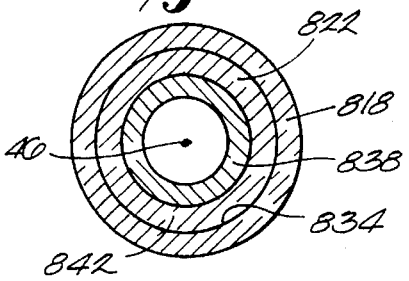
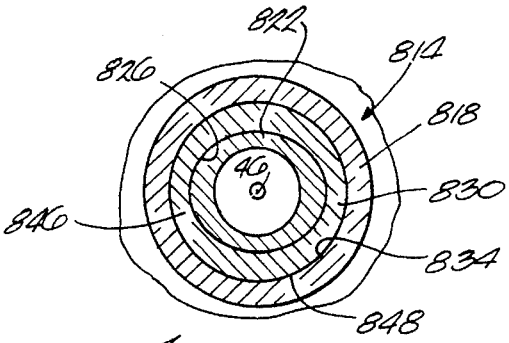
Fig. 21
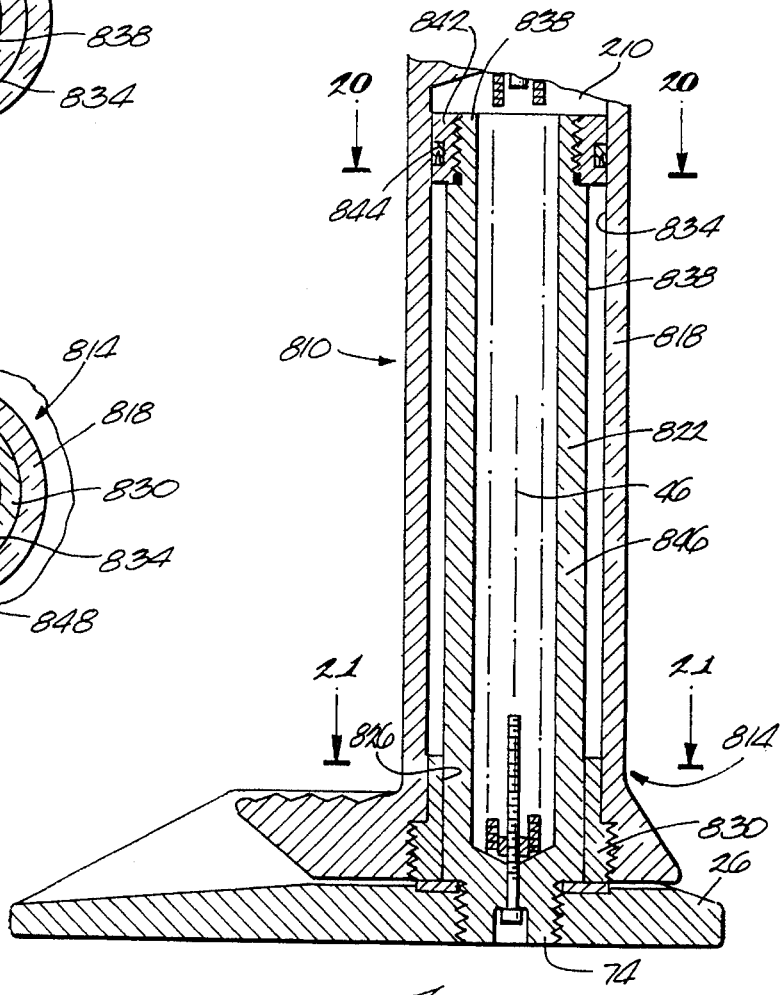
Fig. 19
Fig. 22
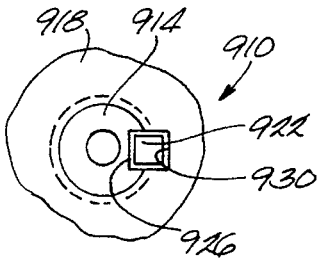

HYDRAULIC TOE JACK

BACKGROUND OF THE INVENTION

1. Technical Field

The invention relates to jacks for lifting loads, and more particularly to hydraulic toe jacks.

2. Related Prior Art

Toe jacks are used for lifting loads in general industrial applications such as the rigging of machinery, automotive maintenance and material handling, and in the maintenance of railroad rails and beds. A toe jack typically includes a base and a lifting surface or "toe" that is moveable to a retracted position wherein the toe is flush or closely spaced with the base. Because the toe can be positioned so as to be closely spaced to the base, toe jacks are well-suited for use in close quarters and in applications wherein the object to be lifted provides minimal clearance for the jack.

Toe jacks can be either hydraulically or mechanically operated and can be used to lift extremely heavy loads over a relatively small distance. Because of the mechanical advantages that can be realized by using hydraulic fluid as a medium for operating a toe jack, hand operable hydraulic toe jacks can be used to lift loads exceeding several tons. However, a toe jack that is subjected to such heavy loading, must contain and maintain relatively high hydraulic fluid pressures within the toe jack.

SUMMARY OF THE INVENTION

Since the introduction of concrete as a material used for railroad ties, toe jacks used for the maintenance and repair of railroad beds must have an increased lifting capacity. For example, a concrete tie may weigh approximately 800 lbs. whereas a wooden tie may weight approximately 200 lbs. However, it is desirable for such toe jacks to be relatively easily portable. Also, a toe jack subjected to heavy loading should remain stable as it extends to lift the load.

In general, the invention provides a relatively light weight, high capacity hydraulic toe jack that is well-suited for the maintenance and repair of railroad beds. The toe jack has few components, thereby providing a portable toe jack, and also has a relatively high lifting capacity.

In one embodiment, the invention provides a hydraulic jack including a base adapted to be supported by the ground, an elongated piston extending from the base and defining an axis, a generally cylindrical toe housing having a closed end and an open end, the toe housing defining an inner surface surrounding a portion of the piston, the toe housing being movable relative to the piston along the axis, and the toe housing including a toe projecting from the open end of the toe housing, the toe including a lifting surface, and supporting means for supporting the toe housing on the piston for movement relative to the piston along the piston axis, the supporting means including interengaging means on the inner surface of the toe housing and on the piston for preventing rotation of the toe housing relative to the piston about the axis and a bushing fixed to the toe housing and having therethrough a bore surrounding and slidably engaging the piston.

In another embodiment, the invention provides a hydraulic jack including a base assembly including an elongated piston defining an axis, a generally cylindrical toe housing supported by the piston for movement relative to the piston along the axis, the toe housing and the piston defining an expandable cavity, and the toe housing having extending therein a fluid inlet passage communicating with the expandable cavity, a fluid source attachment including a fluid reservoir adapted to contain a fluid supply, a fluid passage communicable with the reservoir and communicating with the fluid inlet passage and a hand pump operable to cause a flow of fluid from the reservoir through the fluid passage into the cavity, and mounting means for removably supporting the fluid source attachment on the toe housing to afford fluid communication between the fluid passage and the fluid inlet passage and alternatively to afford ready removal of the fluid source attachment and to permit fluid communication between the fluid inlet passage and an alternative high-pressure fluid supply.

In another embodiment, the invention provides a hydraulic jack including a base including an elongated piston, a generally cylindrical toe housing supported by the piston for movement along a portion of the length of the piston, the toe housing and the piston defining therebetween an expandable cavity, and a pump assembly mounted on the toe housing, the pump assembly including a fluid reservoir communicable with the cavity and adapted to contain a fluid supply and including a hand operable pump for pumping a flow of fluid from the reservoir to the cavity, the pump including a first handle that is moveable relative to the toe housing to pump fluid and a second handle that is selectively moveable relative to the first handle between a lifting position wherein the second handle prevents movement of the first handle relative to the toe housing and an operating position wherein the second handle affords movement of the first handle relative to the toe housing.

In another embodiment, the invention provides a hydraulic jack including a base adapted to be supported by the ground, an elongated piston extending from the base and defining an axis, a toe housing having a closed end and an open end, the toe housing defining an inner surface surrounding a portion of the piston, the toe housing and the piston defining therebetween an expandable cavity adapted to contain a supply of fluid under pressure, means for supporting the toe housing for movement relative to the piston along the axis between a retracted position and an extended position, interengaging means on the inner surface of the toe housing and on the piston for preventing rotation of the toe housing relative to the piston about the axis, a seal sealingly fixed to the toe housing adjacent the open end of the toe housing and slidably sealingly engaged with the piston, and a fluid inlet communicating with the cavity and adapted to communicate with a supply of fluid under pressure for moving the toe housing relative to the piston.

In another embodiment, the invention provides a hydraulic jack comprising a base adapted to be supported by the ground, an elongated piston extending from the base and defining an axis, a generally cylindrical toe housing having a closed end and an open end, the toe housing defining an inner surface surrounding a portion of the piston, the toe housing being movable relative to the piston along the axis, and the toe housing including a toe projecting from the open end of the toe housing, the toe including a lifting surface, supporting means for supporting the toe housing on the piston for movement relative to the piston along the piston axis, the supporting means including interengaging means on the inner surface of the toe housing and the on piston for preventing rotation of the toe housing relative to the piston about the axis, the interengaging means including a keyway in the piston that extends in the direction of the axis and a key that is fixed to the inner surface of the toe housing and that extends into the keyway and a bushing sealingly fixed to the piston and sealingly slidably engaging the inner surface of the toe housing.

In another embodiment, the invention provides a hydraulic jack including a base adapted to be supported by the ground, an elongated piston defining a piston axis, the piston having a first end fixed to the base, a second end spaced from the base and an outer surface extending between the first and second ends, a portion of the outer surface of the piston being non-circular in a plane perpendicular to the piston axis, a generally cylindrical toe housing having a closed end and an open end, the toe housing defining an inner surface surrounding a portion of the piston, the toe housing being movable relative to the piston along the axis, and the toe housing including a toe projecting from the open end of the toe housing, the toe including a lifting surface, interengaging means on the inner surface of the toe housing and the on piston for preventing rotation of the toe housing relative to the piston about the axis, the interengaging means including a bushing fixed to the toe housing and having therethrough a non-circular bore that slidingly engages the non-circular portion of the outer surface of the piston, and a bushing sealingly fixed to the piston and sealingly slidably engaging the inner surface of the toe housing.

In another embodiment, the invention provides a hydraulic jack including a base adapted to be supported by the ground, an elongated piston defining a piston axis, the piston having a first end fixed to the base, a second end spaced from the base and an outer surface extending between the first and second ends and being centered on the piston axis, a generally cylindrical toe housing having a closed end and an open end, the toe housing defining an inner surface surrounding a portion of the piston, the inner surface of the toe housing having a first portion that is centered on the piston axis and a second portion that is centered on a second axis offset from the piston axis, the toe housing being movable relative to the piston along the axis, and the toe housing including a toe projecting from the open end of the toe housing, the toe including a lifting surface, and interengaging means on the inner surface of the toe housing and the on piston for preventing rotation of the toe housing relative to the piston about the axis, the interengaging means including a first bushing fixed to first portion of the inner surface of the toe housing and having therethrough a bore that sealingly slidingly engages the piston and a second bushing fixed to the piston and slidably engaging the second portion of the inner surface of the toe housing.

A feature of the invention is the provision of a hydraulic toe jack that remains relatively stable under heavy loading. The toe jack includes a toe that cannot rotate relative to the base of the toe jack as the toe moves away from the base of the toe jack.

Another feature of the invention is the provision of a hydraulic toe jack having a simple construction and having hydraulic seals that are configured to contain hydraulic fluid under high pressure.

Another feature of the invention is the provision of a hydraulic jack that is adapted to be operated with a hand operable pump assembly that can be mounted on the toe jack or alternatively operated by connecting the toe jack to another source of high pressure hydraulic fluid, such as a mechanically operated pump.

Another feature of the invention is the provision of a hydraulic toe jack including a carrying handle that is moveable into a carrying position to allow the jack to be lifted and carried and to prevent operation of the pump of the toe jack, and that is movable away from the carrying position to afford operation of the pump of the toe jack.

Another feature of the invention is the provision of a relatively light weight hydraulic toe jack that can be hand carried and that has a high lifting capacity.

Another feature of the invention is the provision of a hydraulic toe jack that is easily repaired and maintained. The toe jack includes a toe housing that is easily removable for repair and maintenance or replacement, even when the toe jack is located in the field. Also, the toe housing is made of a wear resistant material.

Various other features and advantages of the invention will become apparent to those skilled in the art upon review of the following detailed description, claims and drawings.

DESCRIPTION OF THE DRAWINGS

FIG. 4 is a cross-sectional view of the toe jack shown in FIG. 1.

FIG. 5 is a cross-sectional view taken along line 5—5 in FIG. 4.

FIG. 8 illustrates a portion of a toe jack which is in an extended position and which is a first alternative embodiment of the toe jack shown in FIG. 1.

FIG. 9 is a cross-sectional view taken along line 9—9 in FIG. 8.

FIG. 19 illustrates a portion of a toe jack which is a fourth alternative embodiment of the toe jack shown in FIG. 1.

FIG. 20 is a cross-sectional view taken along line 20—20 in FIG. 19.

FIG. 21 is a cross-sectional view taken along line 21—21 in FIG. 19.

FIG. 22 is a bottom view of a toe jack which is a fifth alternative embodiment of the toe jack shown in FIG. 1.

Figure 3:
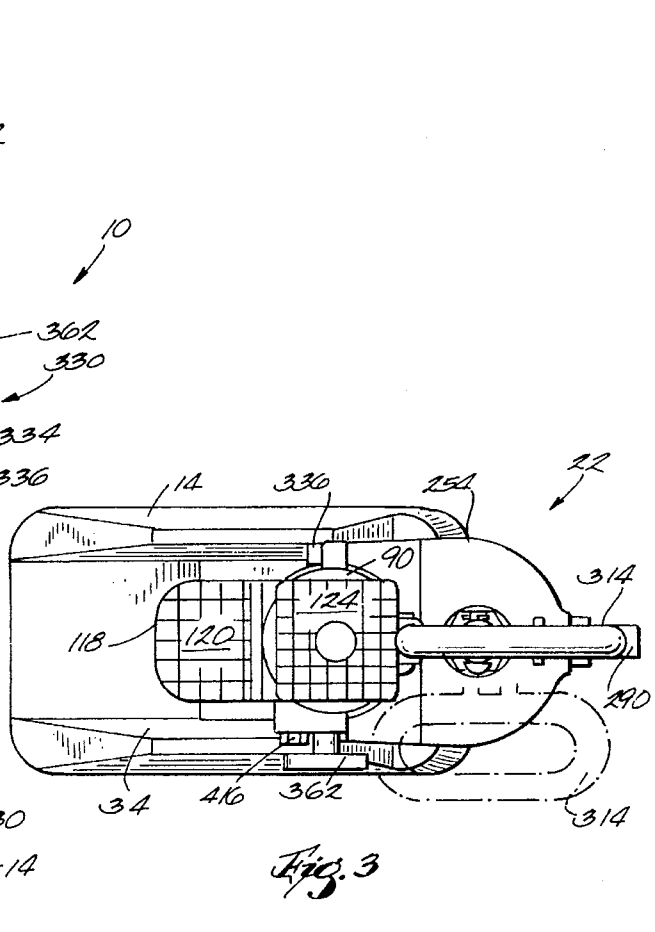
FIG. 3 is a plan view from above of the toe jack shown in FIG. 1.
Figure 2:
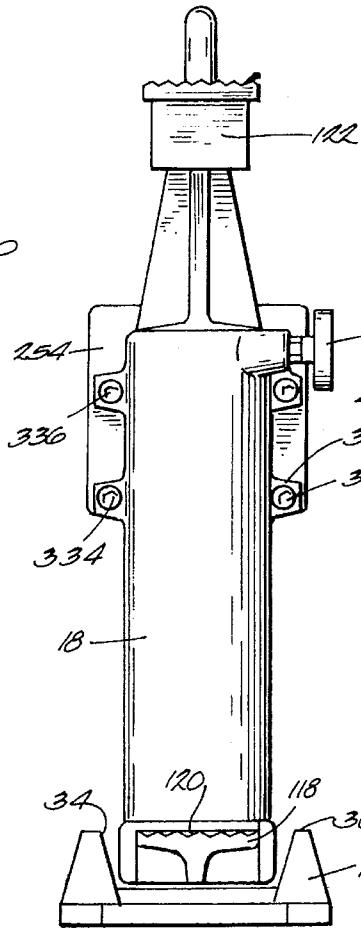
FIG. 2 is a front elevational view of the toe jack shown in FIG. 1 taken from line 2—2.
Figure 1:
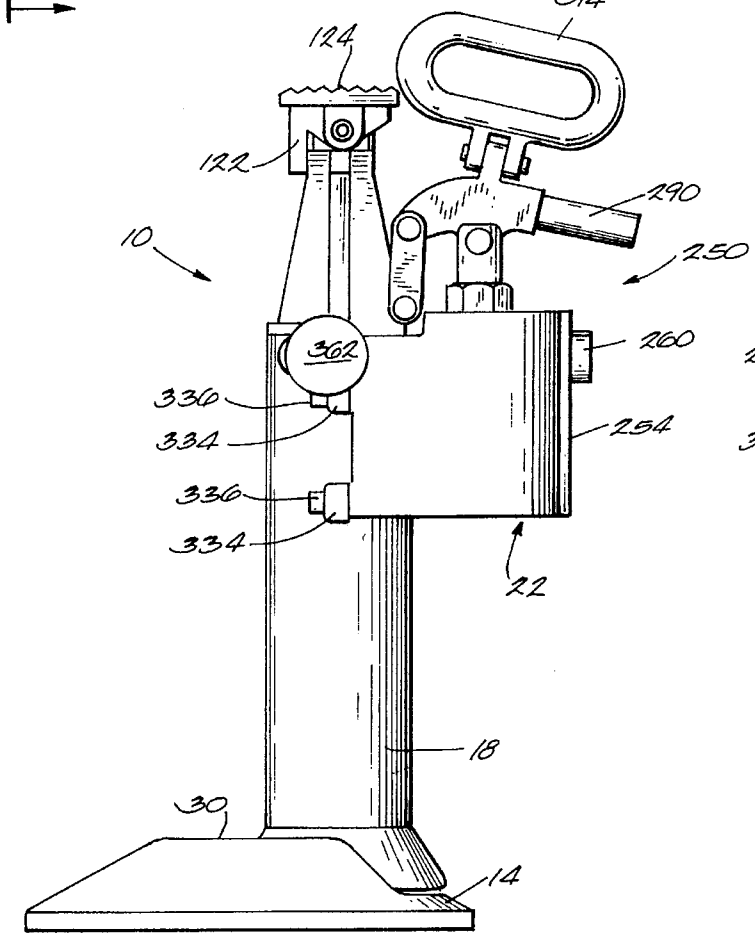
FIG. 1 is a side elevational view of a hydraulic toe jack embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A hydraulic toe jack 10 embodying the invention is illustrated in FIGS. 1–7. The toe jack 10 includes (FIGS. 1–3) a base assembly 14 adapted to be supported by the ground, a toe housing 18 supported by the base assembly 14 for movement relative thereto, and a fluid source attachment or pump assembly 22 removably mounted on the toe housing 18 for supplying high pressure hydraulic fluid.

In particular, the base assembly 14 includes an aluminum base plate 26 (FIG. 4) having a generally flat lower surface and an upper surface 30 that defines an upwardly opening channel 34. The base plate 26 also has extending therethrough a threaded bore 38 located intermediate the channel 34.

The base assembly 14 also includes (FIGS. 4 and 6) an elongated, generally tubular piston 42 that defines a piston axis 46. The piston 42 includes a cylindrical wall 50 that is centered on the axis 46 and that has a closed end 54 and an open end 58. The outer surface of the cylindrical wall 50 extends between the open and closed ends 58, 54 and is generally uniform and smooth. However, for reasons discussed below, in embodiment of the toe jack 10 shown in FIGS. 1–7, the outer surface of the cylindrical wall 50 has therein (FIGS. 4 and 6) a recess 62 that is located adjacent the upper end 58 and that partially houses a key 66. A portion of the key 66 extends radially outwardly from the outer surface of the cylindrical wall 50. The cylindrical wall 50 also defines an interior space 70 that extends between the open upper end 58 and the closed end 54 of the piston 42.

The piston 42 is fixed to the base plate 26 in a manner preventing relative rotation therebetween about the piston axis 46 after assembly of the base assembly 14. In particular, in the embodiment of the toe jack 10 shown in FIGS. 1–7, the closed end 54 of the piston 42 has (FIG. 6) a threaded extension 74 which is screwed into the bore 38 in the base plate 26 so that, when the base plate 26 is on a horizontal surface, the piston 42 and the piston axis 46 extend generally vertically. When the base plate 26 and the piston 42 are so arranged, the interior space 70 within the piston 42 opens upwardly. A spring washer 78 surrounds the threaded extension 74 and is compressed by the piston 42 against the upper surface 30 of the base plate 26. When so compressed, the spring washer 78 prevents relative rotation between the piston 42 and the base plate 26.

The toe housing 18 has (FIG. 4) a generally cylindrical, hollow body 82 which is preferably made of steel so as to be wear resistant. The toe housing 18 also has an open lower end 86, a closed upper end or head 90, and has extending therein a generally cylindrical bore or an interior space 94 extending between the open end 86 and the head 90. The bore 94 of the toe housing 18 is sufficiently long and is sized so that the toe housing 18 can be placed over the piston 42 so as to house substantially the entire length of the piston 42 and so that the inner surface 98 of the toe housing 18 is spaced from the outer surface of the piston 42.

In the embodiment of the toe jack 10 illustrated in FIGS. 1–7, the inner surface 98 of the toe housing 18 has (FIG. 4) a first, upper portion 102 that is generally circular when viewed in a plane extending generally perpendicular to the piston axis 46. The first portion 102 of the inner surface 98 has therein a straight, longitudinally extending recess or keyway 106 that opens radially inwardly toward the piston 42 and that aligns with the recess 62 in the piston 42. The inner surface 98 also has a threaded second, lower portion 110 that is located below the first portion 102 and adjacent the open end 86 of the toe housing 18. The inner surface 98 of the toe housing 18 also has a step 114 which extends radially between the first portion 102 and the second portion 110 of the inner surface 98. The radial extent of the step 114 is greater than that of the keyway 106 so that the keyway 106 does not extend into the second portion 110 of the inner surface 98.

The open end 86 of the toe housing 18 has (FIGS. 4 and 6) a radially projecting extension or toe 118 which provides an upwardly facing lifting surface 120 and which (FIGS. 1, 2 and 4) can be housed in the channel 34 in the base plate 26 so that the lifting surface 120 is flush with the upper surface 30 of the base plate 26.

The head 90 of the toe housing 18 supports a lift attachment 122 which provides an alternative lifting surface 124. Also, for reasons discussed below, the head 90 provides (FIG. 7) a generally planar mounting face 126 which has therein a first opening or fluid inlet passage port 130, and a second opening or fluid outlet passage port 134 that is spaced laterally from, and vertically above, the fluid inlet passage port 130.

The head 90 of the toe housing 18 is generally solid. However, for reasons discussed below, the head 90 has extending therein two bores, namely (FIG. 4) a fluid inlet passage 138 and (FIG. 5) a fluid outlet passage 142, communicating with the pump assembly mounting surface 126. The fluid inlet passage 138 has an end communicating with the fluid inlet passage port 130 and extends directly into the interior space 94 of the toe housing 18. Similarly, the fluid outlet passage 142 has (FIG. 5) an end that communicates with the fluid outlet passage port 134 and also is communicable with the interior space or bore 94 of the toe housing 18. In particular, the fluid outlet passage 142 is communicable with the interior of the toe housing 18 by way of a plugged bore 146 that extends into the toe housing 18 parallel to the fluid outlet passage 142. The plugged bore 146 extends into the uppermost extent of the interior space 94 of the toe housing 18 and (FIG. 4) is directly above the fluid inlet passage 138. First and second valve passages 150, 154 (FIG. 5) each communicate between the plugged bore 146 and the fluid outlet passage 142 and connect the fluid outlet passage 142 with the interior space 94 of the toe housing 18. For reasons explained below, the first and second valve passages 150, 154 define respective first and second valve seats 158, 162 located in the fluid outlet passage 142.

The toe jack 10 also includes supporting means 166 (FIG. 6) for supporting the toe housing 18 on the piston 42 for relative movement therebetween along the axis 46 of the piston 42 between a retracted or closed height position (shown in FIG. 4) wherein the toe housing 18 substantially houses the entire length of the piston 42 (and wherein the lifting surface 120 is flush with the upper surface 30 of the base plate 26) and an extended position (shown in FIG. 6) wherein the toe housing 18 is spaced from the base plate 26 (and wherein the lifting surface is moved out of housed relation with the channel 34).

In embodiment of the jack 10 illustrated in FIGS. 1–7, the supporting means 166 includes (FIG. 6) an annular upper bushing 170 that is threaded onto and fixed to the upper end 58 of the piston 42. The peripheral surface 174 of the upper bushing 170 has a circular cross section in a plane perpendicular to the axis 46 of the piston 42 slidably engages the first portion 102 of the inner surface 98 of the toe housing 18. The upper bushing 170 also has extending radially therethrough a slot 178 which aligns with the recess 62 in the piston 42 to receive an intermediate portion of the key 66. The upper bushing 170 fixes the key 66 to the piston 42 so that the distal portion of the key 66 extends radially outwardly of the upper bushing 170 into the keyway 106.

The supporting means 166 also includes (FIG. 6) an annular lower bushing 182 that is threaded into and is fixed to the open end 86 of toe housing 18. The upper surface of the lower bushing 182 abuts step 114 in the inner surface 98 of the toe housing 18 and the lower surface of the lower bushing 182 is flush with the lower extent of the toe housing 18. An O-ring 186 surrounds the upper peripheral surface of the lower bushing 182 and is located between the step 114 and the threads on the outer surface of the lower bushing 182 to form therebetween a seal.

The lower bushing 182 has extending therethrough a bore 190 surrounding the piston 42. The bore 190 includes an annular recess 192 which houses a bottom packing or seal which is in the form of a "U-cup" 194. The U-cup 194 is an annular member formed by an endless, upwardly opening channel and has an inner surface 202 slidably, sealingly engaged with the piston 42.

A suitable material for the upper and lower bushings 170, 182 is cast iron impregnated with zinc and is provided by the C. E. Gobeil Company, Inc., St. Paul, Minn. under material designation MPIF F 0005-20 sintered iron, sealed (zinc impregnated).

The supporting means 166 also includes (FIG. 6) interengaging means 206 on the piston 42 and on the toe housing 18 for preventing relative rotation between the piston 42 and the toe housing 18 about the longitudinal axis 46 of the piston 42. In the embodiment of the toe jack 10 illustrated in FIGS. 1–7, the interengaging means 206 includes (FIG. 6) the interengagement of the key 66 and the keyway 106. The portion of the key 66 extending radially past the upper bushing 170 extends into and engages the keyway 106 to prevent rotation of the toe housing 18 relative to the piston 42 about the axis 46. Because the keyway 106 extends along the entire first portion 102 of the inner surface 98 of the toe housing 18, the key 66 and keyway 106 prevent rotation of the toe housing 18 relative to the piston 42 throughout the range of positions between the extended and retracted positions.

Figure 6:
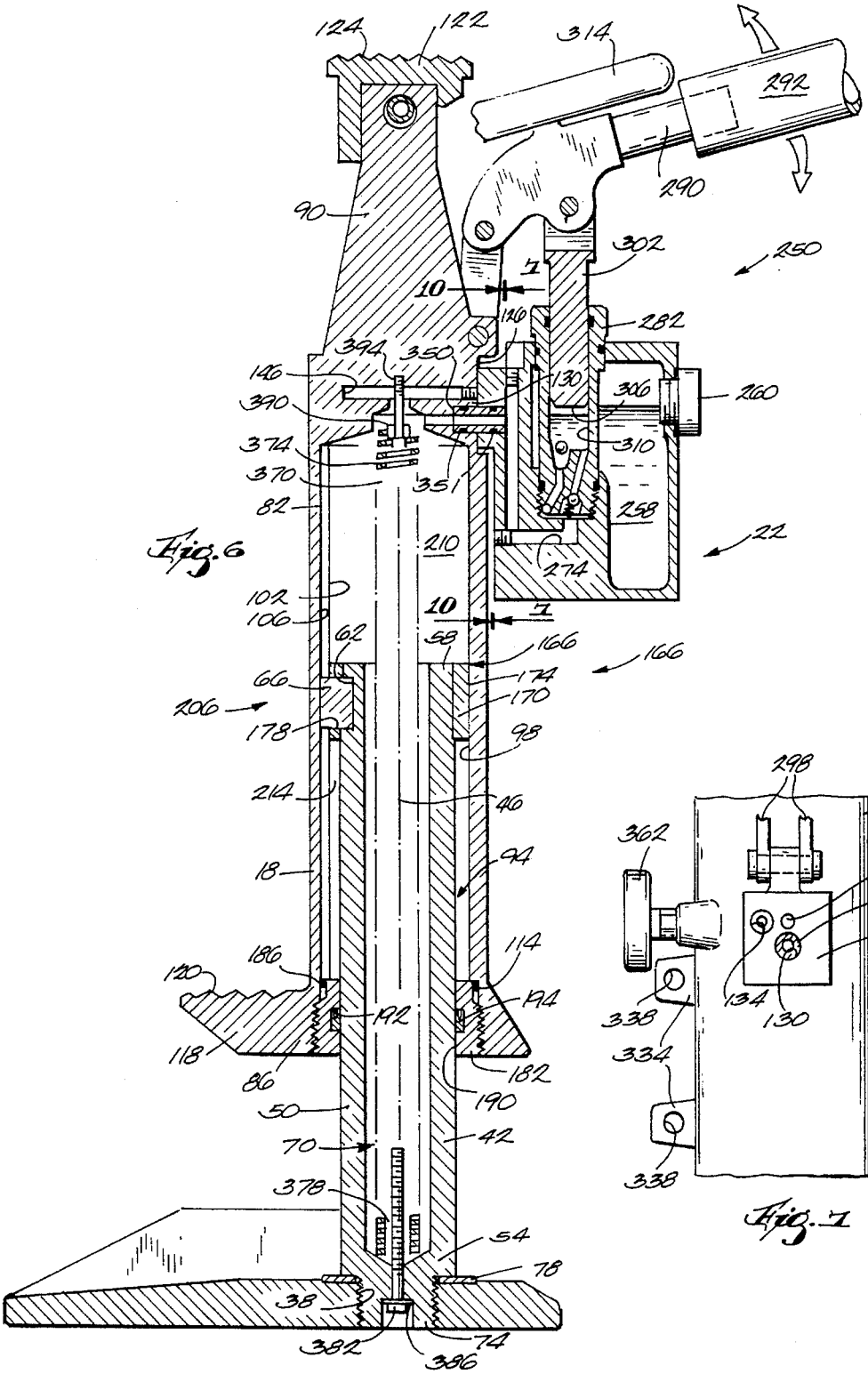
FIG. 6 is view similar to FIG. 4 illustrating the toe jack in an extended position.
Figure 7:
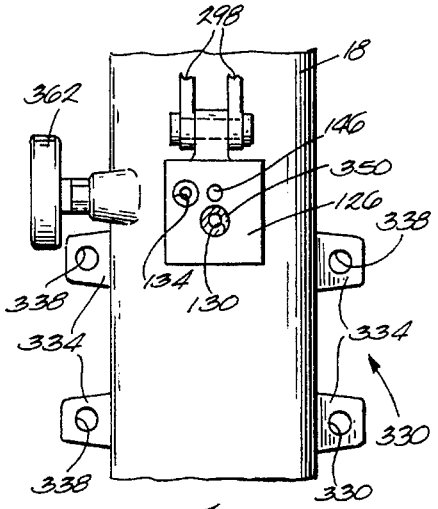
FIG. 7 is a cross-sectional view taken along line 7—7 in FIG. 6.

As best shown in FIG. 6, the piston 42 and toe housing 18 define therebetween an expandable cavity 210, i.e., the space 214 between the outer surface of the piston 42 and the inner surface 98 of the toe housing 18 above the lower bushing 182, the interior space 70 of the piston 42, the fluid inlet passage 138 (shown in FIG. 4), the outlet passage 142 (shown in FIG. 5), and the plugged bore 146 in the head 90 of the toe housing 18, which is adapted to contain a supply of fluid under pressure. When the toe housing 18 is retracted as shown in FIG. 4, the volume of the cavity 210 is at a minimum. Extending the toe housing 18 maximizes the volume of the cavity 210.

The toe jack 10 also includes means 250 for supplying fluid under pressure to the cavity 210 for moving the toe housing 18 relative to the piston 42 between the retracted position and the extended position. As discussed below, various suitable sources of high pressure hydraulic fluid can be used in association with the toe jack 10 to extend the toe housing 18. However, in the illustrated toe jack 10, the fluid supply means 250 is provided by the pump assembly 22 which is removably mounted to the toe housing 18.

Figure 10:
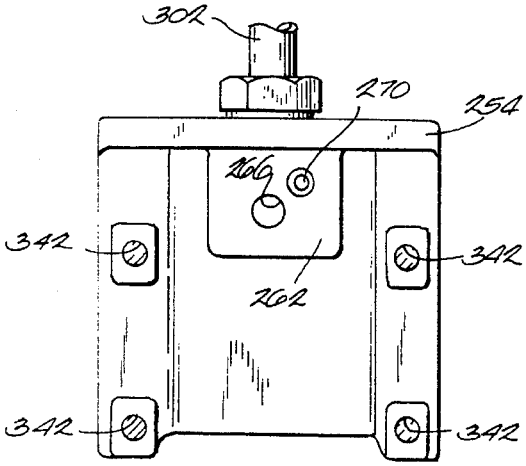
FIG. 10 is a front view of the pump housing taken generally along line 10—10 in FIG. 6.

The pump assembly 22 includes (FIGS. 4 and 10) a pump housing 254 defining a fluid reservoir 258 adapted to contain a supply of hydraulic fluid. A fill cap 260 provides access to the reservoir 258. The pump housing 254 includes (FIG. 10) a generally planar mounting face 262 which has therein two openings: namely, a fluid passage port 266 and a reservoir port 270 (FIG. 5). The pump housing 254 also includes (FIG. 4) a fluid passage 274 which communicates between the fluid passage port 266 and the fluid reservoir 258. The pump housing 254 also includes (FIG. 5) a reservoir passage 278 which communicates between the reservoir port 270 and the fluid reservoir 258.

The pump assembly 22 also includes (FIGS. 4 and 6) a pump piston cylinder 282 that is supported by the pump housing 254 and that extends into the fluid reservoir 258. The pump piston cylinder 282 defines a cylindrical inner surface that opens outwardly of the pump housing 254.

The pump assembly 22 also includes a pump 286 (FIG. 4) that is hand operable for causing a flow of fluid from the fluid reservoir 258 to the cavity 210. The pump 286 includes a first pump handle 290 having an end 294 pivotably connected to the head 90 of the toe housing 18 through a link 298 that is pinned at opposite ends to both the head 90 of the toe housing 18 and the end 294 of the pump handle 290. The pump handle 290 is also connected to a pump piston 302 that is slidably received by the pump piston cylinder 282. The pump piston 302 has (FIG. 6) a lower face 306 that, with the pump piston cylinder 282, defines a pump chamber 310. The pump handle 290 is moveable relative to the toe housing 18 to reciprocate the pump piston 302 and to vary the size of the pump chamber 310. An extension 292 (shown in phantom in FIGS. 4 and 6) can be fixed to the pump handle 290.

The pump assembly 22 also includes (FIGS. 1, 3 and 4) a second or lifting handle 314 that is pivotably mounted on the first pump handle 290 for selective movement relative thereto between (FIG. 1) a lifting position wherein the lifting handle 314 prevents reciprocating movement of the pump handle 290 relative to the toe housing 18 and (FIG. 6) an operating position wherein the lifting handle 314 affords movement of the pump handle 290 relative to the toe housing 18. In particular, the lifting handle 314 has (FIG. 1) a portion that closely spaced to the lift attachment 122 on the toe housing 18 when the lifting handle 314 is in the lifting position, thereby preventing reciprocation of the pump handle 290. However, as shown in FIG. 3, the lifting handle 314 can be pivoted to one side of the toe housing head 90 and lift attachment 124 to afford reciprocation of the pump handle 290 and operation of the pump assembly 22.

The pump assembly 22 also includes (FIG. 4) a pair of one-way valves for affording a flow of fluid under pressure from the reservoir 258 into the fluid passage 274 and for preventing back-flow of fluid from the fluid passage 274 into the reservoir 258. In particular, the pump assembly 22 includes an inlet valve 318 that affords communication between the pump chamber 310 and the fluid reservoir 258. As the pump piston 302 is drawn away from the inlet valve 318, hydraulic fluid is drawn into the pump chamber 310. As the pump piston 302 moves toward the bottom of the pump piston cylinder 282, fluid is forced past a spring-loaded outlet valve 322, through the fluid passage 274 and the fluid inlet passage 138 and into the cavity 210.

The toe jack 10 also includes (FIGS. 4, 5 and 7) mounting means 330 for removably supporting the pump assembly 22 on the toe housing 18. The mounting means 330 supports the pump assembly on the mounting surface 126 to afford fluid communication between the fluid passage 274 and the fluid inlet 138. The mounting means 330 also affords ready removal of the pump assembly 22 for maintenance, repair or replacement of the pump assembly 22. In this regard, the pump assembly 22 can be removed from the toe jack 10 to permit the use of an alternative high-pressure fluid supply (not shown) such as an electric or gas-powered pump.

In particular, the mounting means 330 includes (FIG. 7) mounting flanges 334 extending outwardly from opposite sides of the toe housing 18. Each mounting flange 334 has therethrough (FIG. 2) a bolt 336 extending through a respective bolt hole 338 that is registerable with (FIG. 10) a corresponding bolt hole 342 in the pump housing 254. When the pump assembly 22 is so mounted on the toe housing 18, the mounting face 262 mates with the mounting surface 126 on the toe housing 18, the fluid inlet passage port 130 registers with the fluid passage port 266, and the fluid outlet passage port 134 registers with the reservoir port 270.

The mounting means 330 further includes (FIGS. 5–7) a tubular valve or port adapter 350 extending from the fluid inlet passage 138 into the fluid passage 274. The extension of the port adapter 350 into both the toe housing 18 and the pump assembly 22 helps assure the integrity of the fluid communication therebetween. In addition, however, when the pump assembly 22 is removed from the toe housing 18, the valve adapter 350 remains with the toe housing 18 and extends outwardly of the fluid inlet passage port 130. A sealed connection between the pump assembly 22 and the toe housing 18 is provided in part by (FIG. 5) an o-ring 346 surrounding the fluid outlet port 134 and the reservoir port 270. Similarly, O-rings 351 (shown in FIG. 6) surround the opposite ends of the port adaptor 350 and provide a fluid tight seal with passages 138 and 274.

Figure 11:
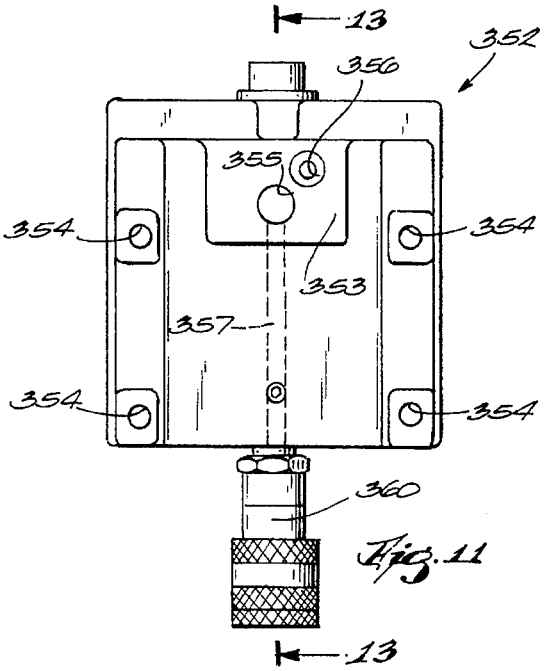
FIG. 11 is a view that is similar to FIG. 10 and that illustrates a remote fluid source adapter.
Figure 12:
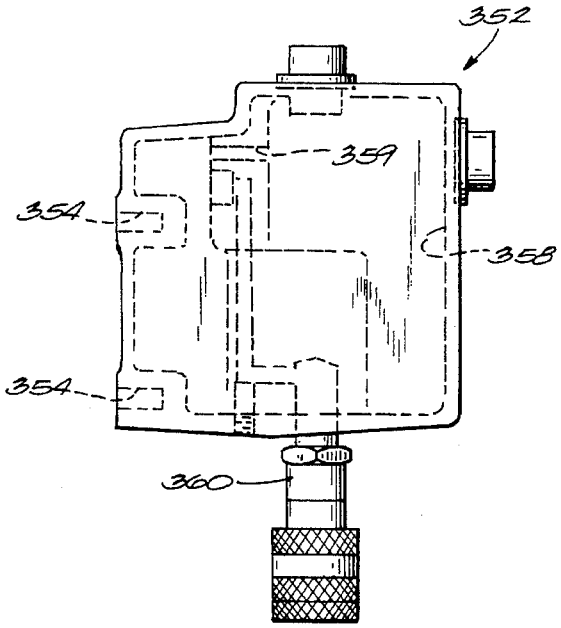
FIG. 12 is a side view of the remote fluid source adapter shown in FIG. 11.
Figure 13:
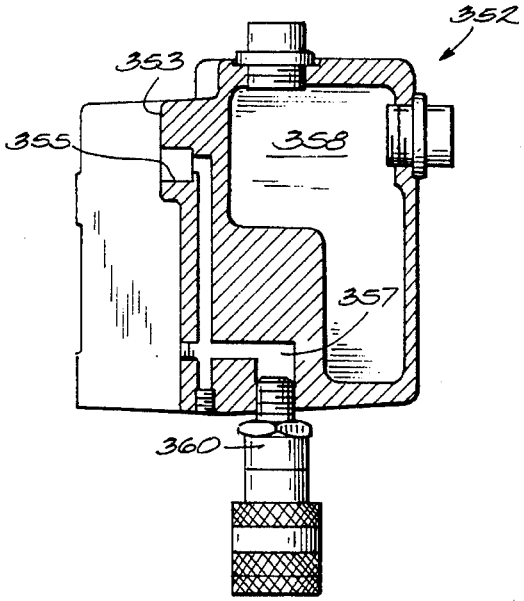
FIG. 13 is a cross-sectional view taken generally along line 13—13 in FIG. 11.

FIGS. 11–13 illustrate an alternative fluid source attachment or adapter 352 for use in connecting a remote source of high-pressure fluid (not shown) to the toe jack 10. The remote source adapter 352 can be removably supported on the toe jack 10 by the mounting means 330 and has a toe housing mounting face and bolt holes 354 that correspond to the mounting face 262 and bolt holes 342 of the pump assembly 22. In particular, the remote source adapter 352 includes (FIG. 11) a fluid passage port 355 and a reservoir port 356 in the mounting face 353; an inlet passage 357 (FIG. 13) communicating with the fluid passage port 355; a fluid reservoir 358; and a reservoir passage 359 (shown in FIG. 12) communicating between the reservoir port 356 and the fluid reservoir 358. The primary difference between the pump assembly 22 and the remote source adapter 352 is that the inlet passage 357 in the remote source adapter 352 is not communicable with the fluid reservoir 358. Rather, the inlet passage 357 communicates with the remote source of hydraulic fluid (not shown) via a quick release hydraulic fitting 360 mounted on the bottom of the remote source adapter 352.

When mounted on the toe housing 18 and connected to the remote source of hydraulic fluid (not shown) the remote source adapter 352 affords fluid communication between the cavity 210 in the toe jack 10 and the remote source of hydraulic fluid.

The mounting means 330 thus affords the ready connection of the toe jack 10 with a fluid source attachment, i.e. the pump assembly 22, the remote source adapter 352 or similar device for conducting a flow of hydraulic fluid to the cavity 210, to provide a means of fluid communication therebetween. The mounting means 330 affords the ready disconnection of the pump assembly 22 from the toe housing 18 and the connection of the toe housing 18 with the remote fluid supply through use of the remote source adapter 352. From the foregoing, it should also be readily apparent that pressurized fluid from either the pump assembly 22 or an alternative source can be introduced to the expandable cavity 210 to move the toe housing 18 away from the base plate 26.

The return of pressurized fluid from the cavity 210 to either the reservoir 258 in the pump housing 254 or the remote source adapter reservoir 358 is controlled, in part, by (FIG. 5) an adjustable outlet valve 361 located on the toe housing 18. The outlet valve 361 controls the flow of fluid from the cavity 210 via the plugged bore 146 through the second valve passage 154 into the fluid outlet passage 142. The outlet valve 358 includes a thumb screw 362 which extends through the head 90 of the toe housing 18, and a first ball element 366 engaged with the thumb screw 362 and engageable with the second valve seat 162. The thumb screw 362 can be backed away from the second valve seat 162 so that fluid under pressure can unseat the first ball element 366 and can return through the second valve passage 154, through the fluid outlet passage 142 and into either of the fluid reservoirs 258 or 358, thereby allowing the toe housing 18 to retract over the piston 42.

One advantage to the location of the outlet valve 358 on the toe housing 18 is that, if the pump assembly 22 is removed from the toe housing 18 and the remote source adapter 352 is connected to the toe jack 10, the outlet valve 358 remains with the toe housing 18 to control the flow of fluid through the fluid outlet passage 142. This arrangement minimizes the fluid pressure on the sealed connection between the fluid outlet passage port 134 and either of the reservoir ports 270 or 356 during pressurization of the cavity 210. This arrangement also simplifies the constructions of the pump assembly 22 and the remote source adapter 352 by providing a single outlet valve 361 that can be used with either the pump assembly 22 or the remote source adapter 361.

The toe jack 10 also includes (FIG. 6) a retraction spring assembly 370 that connects the toe housing 18 and the base assembly 14. The retraction spring assembly 370 includes an extension spring 374 that is located within the interior space 70 of the piston 42 and that is fixed at opposite ends to the closed end 54 of the piston 42 and the closed end of the toe housing 18. In particular, the lower end of the extension spring 374 is fixed to the closed end 54 of the piston 42 by a first turnbuckle or threaded nut 378 that is fixed to the extension spring 374 and with a bolt 382 extending through the closed end 54 of the piston 42. The head of the bolt 382 bears against a gasket 386 to maintain the integrity of the cavity 210. A second turnbuckle or threaded nut 390 is fixed to the upper end of the extension spring 374 and is fixed to the head 90 of the toe housing 18 by a bolt 394. The retraction spring assembly 370 applies a slight retracting load against extension of the toe housing 18 and tends to draw the toe housing 18 toward the base plate 26 and toward the retracted position.

The toe jack 10 also includes (FIG. 5) an over-load pressure relief valve 402 which allows pressurized fluid to escape from the cavity 210 under overload conditions via the first valve passage 150 and the fluid outlet passage 142. The safety valve 402 operates independently of the outlet valve 358 and includes a second ball valve element 406 engageable with the first valve seat 158. The safety valve 402 also includes a spring 408 that normally biases the second ball valve element 406 into engagement with the first valve seat 158, and a set screw 412 that holds the spring 408 in position. Both the spring 408 and set screw 412 are located in a threaded bore extending into the head 90 of the toe housing 18.

The safety valve 402 can be adjusted, through positioning of the set screw 412, to set the threshold fluid pressure corresponding to a maximum load for the toe jack 10. At the threshold pressure, fluid unseats the second ball valve element 406 and flows through the first valve passage 150, into the fluid outlet passage 142, and into the fluid reservoir of the fluid source attachment mounted on the toe jack 10. The set screw 412 is not ordinarily repositioned after the proper position of the set screw 412 has been determined. The set screw 412 is located behind a screw cap 416 which must be removed prior to the adjustment of the set screw 412.

The toe jack 10 is operable as follows. When the toe housing 18 is to be extended, the outlet valve 358 should be closed and the toe jack 10 should be connected to a source of high pressure hydraulic fluid. Should the pump assembly 22 be used as the source of high pressure fluid, the pump assembly 22 should be mounted on the toe housing 18 and filled with a supply of fluid. The carrying handle can then be moved to the operating position, and the pump handle 290 can then be reciprocated.

As the pump piston 302 is drawn away from the inlet one-way valve 318, hydraulic fluid is drawn into the pump chamber 310. As the pump piston 302 moves toward the bottom of the pump piston cylinder 282, fluid is forced past the outlet valve 322, into the fluid passage 274, through the fluid inlet passage 138 and into the cavity 210. As additional fluid enters the cavity 210, the cavity 210 expands by lifting the toe housing 18 away from the base plate 26.

Should an alternative source of high pressure hydraulic fluid be used, the pump assembly 22 can be removed from the toe housing 18 and the outlet valve 358 on the toe housing 18 should be closed. The remote source adapter 352 can then be mounted on the toe jack 10 and connected to a suitable source of hydraulic fluid.

The toe jack 10 is operable to retract the toe housing 18 through the operation of the outlet valve 361, or by appropriate valve means associated with the remote source of hydraulic fluid. The thumb screw 362 is unscrewed to allow fluid in the cavity 210 to unseat the outlet valve element 366 and to flow through the fluid outlet passage 142 into the either reservoir 258 of the pump assembly 22 or the reservoir 358 of the remote source adapter 352. In the event that the toe jack 10 is not under load when the toe housing 18 is being retracted, the retraction spring assembly 370 operates to draw the toe housing 18 toward the base plate 26.

FIGS. 8 and 9 illustrate a portion of a toe jack 510 which is an alternative embodiment of the toe jack 10. The toe jacks 10 and 510 are identical except for the differences explained below, and common elements are identified with common reference numerals. In the toe jack 510 the supporting means 514 for affording movement of the toe housing 518 relative to the piston 42 along the piston axis 46 between the extended and retracted positions includes the sealed, sliding contact of the first portion 524 of the inner surface 522 of the toe housing 518 and the outer surface 526 of an upper bushing 530. As best shown in FIG. 9, the first portion 524 of the inner surface 522 of the toe housing 518 is generally smooth and uninterrupted, and has a non-circular, or slightly elliptical, profile when viewed in a plane perpendicular to the piston axis 46.

The upper bushing 530 is threaded onto and fixed to the upper end 58 of the piston 42. The upper bushing 530 also has a non-circular, or slightly elliptical, peripheral surface 526 that slidingly engages the first portion 524 of the inner surface 522. This sliding engagement between the upper bushing 526 and the toe housing 518 affords sliding of the toe housing 518 relative to the piston 42 along the piston axis 46 but prevents relative rotation of the toe housing 518 about the piston axis 46. Thus, the toe jack 510 includes interengaging means 518 for preventing relative rotation between the toe housing and the piston 42 about the piston axis 46 including sliding, mating contact between non-circular surfaces of the first portion 524 of the inner surface 522 of the toe housing 518 and the outer surface 526 of the upper bushing 530.

The supporting means 514 also includes the threaded and sealed engagement of the second portion 110 of the inner surface 522 of the toe housing 518 and the periphery of a lower bushing 182 which is sealingly engaged with the piston 42. The lower bushing 182 and the second portion 110 of the inner surface 522 of toe housing 518 have respective outer diameters that are larger than that of the first portion 524 of the inner surface 522 and that are generally circular when viewed in a plane perpendicular to the piston axis 46. Accordingly, the non-circular peripheral profiles of the upper bushing 530 and the first portion 524 of the toe housing 518 do not affect the arrangement for connecting the toe housing and the lower bushing 182 and for sealing between the lower bushing 182 and the piston 42.

Figure 14:
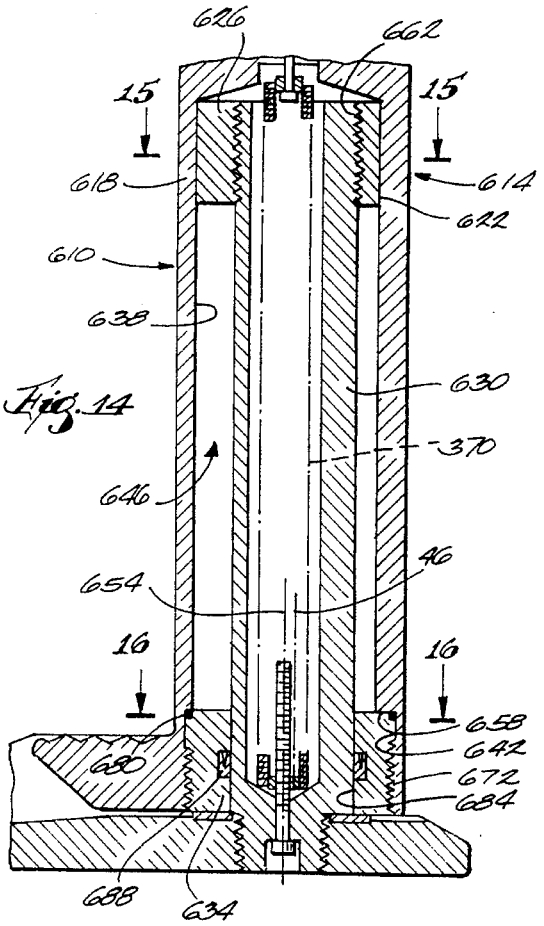
FIG. 14 illustrates a portion of a toe jack which is a second alternative embodiment of the toe jack shown in FIG. 1.
Figure 15:
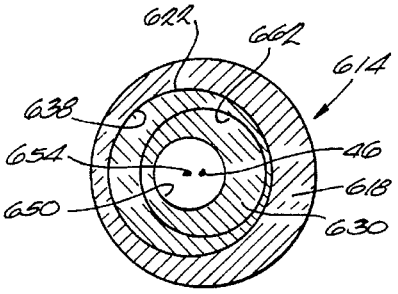
FIG. 15 is a cross-section view taken along line 15—15 in FIG. 14.
Figure 16:
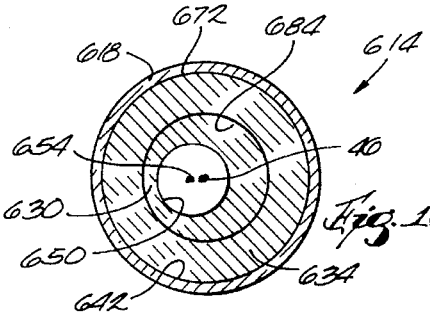
FIG. 16 is a cross-sectional view taken along line 16—16 in FIG. 14.

FIGS. 14–16 illustrate a portion of a toe jack 610 which is a second alternative embodiment of the toe jack 10. The toe jacks 10 and 610 are identical except for the differences explained below, and common elements are identified with common reference numerals. The supporting means 614 illustrated by the toe jack 610 affords movement of the toe housing 618 along the piston axis 46 through slidable engagement between the toe housing 618 and the outer surface 622 of the upper bushing 626, which is fixed to the piston 630, and between the piston 630 and the lower bushing 634, which is fixed to the toe housing 618. The supporting means 614 prevents relative rotation between the toe housing 618 and the piston 630 about the piston axis 46 by providing (FIGS. 15 and 16) radially offset upper and lower portions 638, 642 of the bore 646 extending into the toe housing 618, and by providing upper and lower bushings 626, 634 that accommodate the offset portions 638, 642 of the toe housing bore 646.

In particular, and as shown in FIGS. 14–16, the piston 630 extends along the piston axis 46 and is generally tubular. The outer surface of the piston 630 is generally cylindrical and is uniformly centered on the piston axis 46. The bore 650 extending downwardly into the piston 626 for housing the retraction spring assembly 370 is also cylindrical but, for reasons explained below, is centered on a second axis or spring axis 654 that is radially offset (to the left in FIGS. 14–16) from the piston axis 46 so that the wall thickness of the piston varies.

A radially extending step 658 is located between (FIG. 14) the upper portion 638 and the lower portion 642 of the toe housing bore 646. The lower portion 642 of the toe housing bore 646 is threaded and is centered on the piston axis 46. However, the upper portion 638 of the toe housing bore 646 is centered on the spring axis 654 and, as best shown in FIG. 14, is therefore radially offset (to the left in FIG. 14) from the lower portion 642 of the toe housing bore 646. The bore 650 in the piston 630 and the upper portion 638 of the toe housing bore 646 are both centered on the spring axis 654 so that the retraction spring assembly 370 can act along a single axis.

The radial offset of the upper and lower portions 638, 642 of the toe housing bore 646 is accommodated by a decrease in the diameter of the toe housing bore 646 from the lower portion 642 to the upper portion 638. As shown in FIG. 14, the diameter of the upper portion 638 of the toe housing bore 646 is smaller than that of the lower portion 642. The radial step 658 serves as a stop for the lower bushing 634, and varies in radial extent from one side of the toe housing bore 646 to the other. In particular, the offset between the upper and lower portions 638, 642 of the housing bore 646 is reflected in the difference in the radial extent of the step 658 on the side of the toe housing 618 nearer the piston axis 46 (on the right in FIG. 14) which is greater than the extent of the step 658 on the side of the toe housing 618 nearer the spring axis 654 (on the left in FIG. 14).

As a result of the offset between the upper and lower portions 638, 642 of the toe housing bore 646, the upper and lower portions 638, 642 of the toe housing bore 646 are unequally spaced from the outer surface of the piston 630, which is uniformly centered on the piston axis 46. The configuration of the upper bushing 626 accommodates the offset between the upper portion 638 of the toe housing bore 646 (which is centered on the spring axis 654) and the outer surface of the piston 630 (which is centered on the piston axis 46). As shown in FIGS. 14 and 15, the outer surface 622 of the upper bushing 626 is centered on the spring axis 654 and slidably engages the upper portion 638 of the toe housing bore 646. However, the bore 662 extending through the upper bushing 626 is centered on the piston axis 46. Because the outer surface 622 of the upper bushing 626 is centered on the spring axis 654, and because the bore 662 therethrough is centered on the piston axis 46, the wall thickness of the upper bushing 626 varies. The upper bushing 626 is threaded onto the upper end of the piston 630 and is fixed thereto by a locking screw (not shown).

As shown in FIG. 16, the lower bushing 634 has an outer surface 672 that is generally cylindrical and that is centered on the piston axis 46. The lower bushing 634 is threaded into the lower portion 642 of the toe housing bore 646 and is fixed thereto by a locking screw (not shown). An O-ring 680 located between the lower bushing 634 and the toe housing 618 insures the hydraulic integrity of the cavity 210. The bore 684 in the lower bushing 634 is also centered on the piston axis 46 and slidably engages the piston 630. A U-cup 688 in the lower bushing 634 forms a sliding seal between the lower bushing 634 and the piston 630.

The toe housing 618 is thus supported for movement along the piston axis 46 by the sliding engagement of the upper portion 638 of the toe housing bore 646 along the outer surface 622 of the upper bushing 626 and by the bore 684 of the lower bushing 634 along the piston 630. However, the toe housing 618 is prevented from rotating about either of the piston or the spring axes 46, 654. Such rotation of the toe housing 618 would require common rotation of the upper portion of the toe housing 618 about the spring axis 654 and rotation of the lower portion of the toe housing 618 about the piston axis 46. However, since the engaged surfaces, i.e., 638 and 622, of the upper bushing 626 and the toe housing 618 are centered on the spring axis 654, and since the engaged surfaces, i.e., 672 and 642 of the lower bushing 634 and the toe housing 618 are centered on the piston axis 46, such rotation is not possible.

Figure 18:
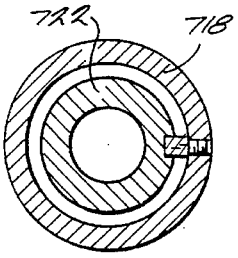
FIG. 18 is a cross-sectional view taken along line 18—18 in FIG. 17.
Figure 17:
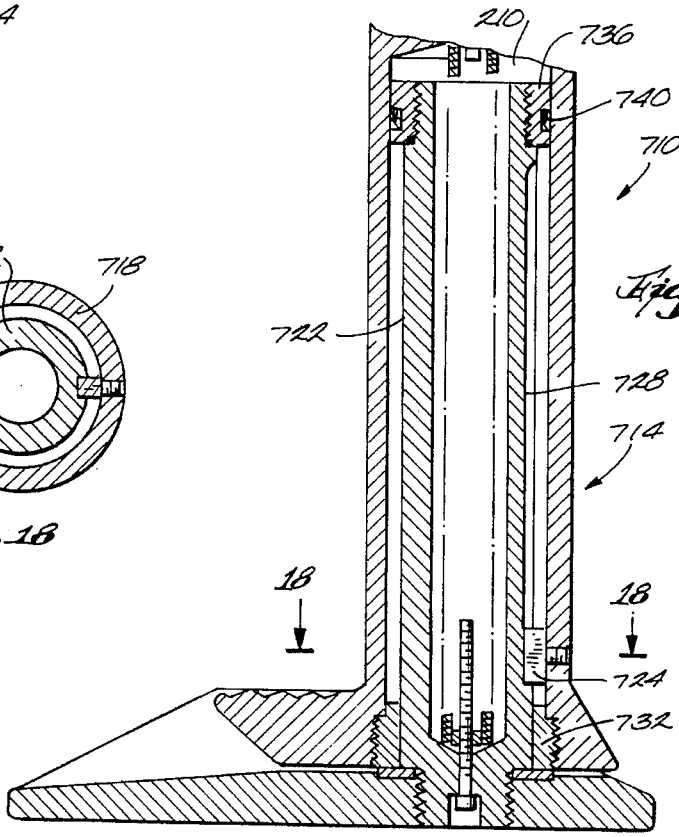
FIG. 17 illustrates a portion of a toe jack which is a third alternative embodiment of the toe jack shown in FIG. 1.

FIGS. 17 and 18 illustrate a portion of a toe jack 710 which is a third alternative embodiment of the toe jack 10. The toe jacks 10 and 710 are identical except for the differences explained below, and common elements are identified with common reference numerals. The supporting means 714 illustrated by the toe jack is similar to the supporting means 166 included in the toe jack 10 in that the supporting means 166 prevents relative rotation between the toe housing 718 and the piston 722 through interengagement of a key 724 and keyway 728. However, in the supporting means 714 the piston 722 has defines the elongated keyway 728 extending upwardly from adjacent the lower bushing 732 to immediately below the upper bushing 736. The upper bushing 736 and the upper portion of the piston 722, i.e., that portion of the piston 722 not including the keyway 728, support therebetween a seal 740 formed by a U-cup and O-ring. The key 724 is fixed to the inner surface of the toe housing 718 adjacent the open end of the toe housing 718 and extends into the keyway 726. The interengagement of the key 724 and keyway 728 affords relative axial movement of the toe housing 718 and piston 722 but prevents relative rotation therebetween about the piston axis 46. Because the respective outer surfaces of the upper bushing 736 and piston 722 are (FIG. 15) circular when viewed in a plane that is perpendicular to the piston axis, and have therebetween a sealed sliding connection located above the keyway 728, the interengagement of the key 724 and keyway 728 does not interfere with the integrity of the expandable cavity 210 located above the upper bushing 736.

FIGS. 19–21 illustrate a portion of a toe jack 810 which is a fourth alternative embodiment of the toe jack 10. The toe jacks 10 and 810 are identical except for the differences explained below, and common elements are identified with common reference numerals. In the toe jack 810, the supporting means 814 for affording movement of the toe housing 818 relative to the piston 822 along the piston axis 46 between the extended and retracted positions includes the sealed, sliding contact of the outer surface of the piston 822 and the bore 826 extending through the lower bushing 830. As best shown in FIGS. 20 and 21, the inner surface 834 of the toe housing 818 is circular when viewed in a plane perpendicular to the piston axis 46. However, as shown in FIG. 21, the outer surface of the piston 822 has an upper portion 838 which is generally circular when view in a plane perpendicular to the piston axis 46, and upon which is threaded an upper bushing 842 having a peripheral outer surface. The upper bushing 842 is fixed to the piston 822 and supports a U-cup 844 affording sealed slidable engagement of the upper bushing 842 and the inner surface 834 of the toe housing 818.

The outer surface of the piston 822 also has a lower portion 846 extending from immediately below the threaded upper portion 838 to the closed lower end of the piston 822. As best shown in FIG. 21, the lower portion 846 of the piston 822 has a peripheral surface 848 which, when viewed in a plane perpendicular to the piston axis 46, is non-circular and which, in the illustrated embodiment, is being generally elliptical. The threaded extension 74 of the piston 822 is circular and is threaded into the base plate 26.

The lower bushing 830 is threaded into and fixed to the lower end 58 of the toe housing. The lower bushing 830 also has a non-circular, or slightly elliptical, bore 850 that slidingly engages the lower portion of the piston 846. The non-circular bore 850 of the lower bushing 830 mates with the lower portion 846 of the piston 822 and the engagement therebetween affords sliding of the lower bushing 830 and the toe housing 818 relative to the piston 822 along the piston axis 46 but prevents relative rotation therebetween about the piston axis 46. Thus, the toe jack 810 includes interengaging means for preventing relative rotation between the toe housing 818 and the piston 822 about the piston axis 46.

The sealed sliding engagement of the upper bushing 842 with the upper portion 828 of the piston 822 defines the lower extent of the expandable cavity 210. As the cavity 210 expands, high pressure hydraulic fluid remains above the upper bushing 842, and the toe housing 818 and lower bushing 830 travel along the lower extent of the piston 822. Accordingly, the elliptical peripheral profiles of the lower bushing 830 and of the piston 822 do not affect the arrangement for sealing the toe housing 818 and the upper bushing 842.

While the embodiments of the toe jacks 510 (shown in FIGS. 8 and 9) and 810 (shown in FIGS. 19–21) illustrate non-circular, mating surfaces of the piston, upper and lower bushings, and the inner surface of the toe housing as being generally elliptical, it should be readily understood that various other non-circular profiles can also be successfully used.

FIG. 22 illustrates a portion of a toe jack 910 which is a fifth alternative embodiment of the toe jack 10. The toe jacks 10 and 910 are identical except for the differences explained below, and common elements are identified with common reference numerals. The piston 914 of the toe jack 910 is threaded into a bore in the base plate 918 just as the piston 42 included in toe jack 10 is threaded into the base plate 26. However, the piston 914 is fixed to the base plate 918 by a key 922 which is located within a keyway that is formed by a radially outwardly opening first channel 926 in the threaded extension of the piston 914 and a second, radially inwardly opening channel 930 located in the base plate 918. The first and second channels 926, 930 align when the piston 914 is threaded into the base plate 918. The key 922 is engages both the piston 914 and the base plate 918 to prevent rotation therebetween.

Various features of the invention are set forth in the following claims:

We claim:

1. A hydraulic jack comprising a base adapted to be supported by the ground, an elongated piston extending from the base and defining an axis, a generally cylindrical toe housing having a closed end and an open end, the toe housing defining an inner surface surrounding a portion of the piston and having a fluid inlet in the inner surface adjacent the closed end, the toe housing being movable relative to the piston along the axis, and the toe housing including a toe projecting from the open end of the toe housing, the toe including a lifting surface, and supporting means for supporting the toe housing on the piston for movement relative to the piston along the piston axis, the supporting means including interengaging means on the inner surface of the toe housing and on the piston for preventing rotation of the toe housing relative to the piston about the axis, the supporting means including an upper bushing fixed to the piston, and a lower bushing fixed to the toe housing and having therethrough a bore surrounding and slidably engaging the piston, the lower bushing and the inner surface of the toe housing defining an expandable cavity communicating with the fluid inlet.

2. A hydraulic jack as set forth in claim 1 wherein the interengaging means includes a keyway that is located in the inner surface of the toe housing and that extends in the direction of the axis, and a key that is fixed to the piston and that extends into the keyway.

3. A hydraulic jack as set forth in claim 2 wherein the lower bushing sealingly engages the piston.

4. A hydraulic jack as set forth in claim 1 wherein the interengaging means includes a keyway that is located in the piston and that extends in the direction of the axis, and a key that is fixed to the inner surface of the toe housing and that extends into the keyway.

5. A hydraulic jack as set forth in claim 1 wherein the inner surface of the toe housing includes a first portion having a longitudinally extending recess and a second portion that is adjacent the open end of the toe housing.

6. A hydraulic jack as set forth in claim 5 wherein the inner surface of the toe housing has a step extending radially between the first portion of the inner surface and the second portion of the inner surface, and wherein radial extent of the step is greater than the radial extent of the recess.

7. A hydraulic jack as set forth in claim 1 wherein the piston has a first end fixed to the base, a second end spaced from the base and an outer surface extending between the first and second ends, wherein a portion of the inner surface of the toe housing is spaced from the outer surface of the piston and is non-circular in a plane perpendicular to the piston axis, and wherein the supporting means includes a bushing fixed to the piston adjacent the distal end and having a peripheral surface that is sized and configured to slidingly mate with the non-circular portion of the inner surface of the toe housing.

8. A hydraulic jack as set forth in claim 1 wherein the lower bushing is sealingly engaged with the piston.

9. A hydraulic jack as set forth in claim 1 wherein the piston has a first end fixed to the base, a second end spaced from the base and an outer surface extending between the first and second ends, wherein a portion of the outer surface of the piston and is non-circular in a plane perpendicular to the piston axis, and wherein the supporting means includes a bushing fixed to the toe housing and having therethrough a non-circular bore that slidingly engages the non-circular portion of the outer surface of the piston.

10. A hydraulic jack as set forth in claim 1 wherein the piston has an outer surface centered on the axis defined by the piston, and wherein the supporting means includes a bushing fixed to the piston and having an outer surface engaged with a portion of the inner surface of the toe housing, the outer surface of the bushing that is fixed to the piston and the portion of the inner surface of the toe housing that is engaged by the bushing fixed to the piston both being centered on an axis that is offset from the axis defined by the piston.

11. A hydraulic jack as set forth in claim 1 and further comprising a pump assembly removably mounted on the toe housing, the pump assembly including a reservoir adapted to contain a supply of fluid and a fluid passage communicable with the reservoir and adapted to communicate with the fluid inlet.

12. A hydraulic jack as set forth in claim 11 wherein the toe housing includes a fluid outlet passage communicable with the cavity and further including an outlet valve on the toe housing for opening and closing the fluid outlet passage, the outlet valve being operable when used either with the pump assembly or when used with an alternative high-pressure fluid supply.

13. A hydraulic jack as set forth in claim 1 and further including a remote source adapter removably mounted on the toe jack and adapted to be connected to a source of high pressure fluid.

14. A hydraulic jack comprising a base assembly including an elongated piston defining an axis, a generally cylindrical toe housing supported by the piston for movement relative to the piston along the axis, the toe housing and the piston defining an expandable cavity, and the toe housing having extending therein a fluid inlet passage communicating with the expandable cavity, a fluid source attachment including a fluid reservoir adapted to contain a fluid supply, a fluid passage communicable with the reservoir and communicating with the fluid inlet passage and a hand pump operable to cause a flow of fluid from the reservoir through the fluid passage into the cavity, and mounting means for removably supporting the fluid source attachment on the toe housing to afford fluid communication between the fluid passage and the fluid inlet passage and alternatively to afford ready removal of the fluid source attachment and to permit fluid communication between the fluid inlet passage and an alternative high-pressure fluid supply.

15. A hydraulic jack as set forth in claim 14 wherein the toe housing has extending therethrough a fluid outlet passage communicable with the cavity, and wherein the toe housing includes an outlet valve for selectively opening and closing the fluid outlet passage to control flow of hydraulic fluid, the outlet valve remaining with the toe housing when the pump assembly is removed from the toe housing.

16. A hydraulic jack as set forth in claim 14 wherein the mounting means includes a port adapter extending between the fluid inlet passage and the fluid passage in the fluid source attachment when the fluid source attachment is mounted on the toe housing.

17. A jack as set forth in claim 14 wherein the toe housing has extending therethrough a fluid outlet passage communicating with the cavity, wherein the fluid inlet passage and the fluid outlet passage respectively have a fluid inlet port and a fluid outlet port terminating at a mounting face on the exterior of the toe housing.

18. A hydraulic jack as set forth in claim 17 wherein the fluid source attachment includes a mounting face having therein a fluid passage port communicating with the fluid passage and a reservoir port communicating with the reservoir, the mounting face on the pump assembly and the mounting face on the toe housing mating so that the fluid inlet port and fluid passage port register and so that the fluid outlet port and reservoir port register.

19. A hydraulic jack as set forth in claim 18 wherein the fluid source attachment is a pump assembly.

20. A hydraulic jack as set forth in claim 18 wherein the fluid source attachment is a remote source adapter.

21. A hydraulic jack comprising a base including an elongated piston, a generally cylindrical toe housing supported by the piston for movement along a portion of the length of the piston, the toe housing and the piston defining therebetween an expandable cavity, and a pump assembly mounted on the toe housing, the pump assembly including a fluid reservoir communicable with the cavity and adapted to contain a fluid supply and including a hand operable pump for pumping a flow of fluid from the reservoir to the cavity, the pump including a first handle that is moveable relative to the toe housing to pump fluid and a second handle that is selectively moveable relative to the first handle between a lifting position wherein the second handle prevents movement of the first handle relative to the toe housing and an operating position wherein the second handle affords movement of the first handle relative to the toe housing.

22. A hydraulic jack comprising a base adapted to be supported by the ground, an elongated piston extending from the base and defining an axis, a toe housing having a closed end and an open end, the toe housing defining an inner surface surrounding a portion of the piston, the toe housing and the piston defining therebetween an expandable cavity adapted to contain a supply of fluid under pressure, means for supporting the toe housing for movement relative to the piston along the axis between a retracted position and an extended position, the means for supporting the toe housing including a first bushing fixed to the piston and a second bushing fixed to the toe housing, interengaging means on the inner surface of the toe housing and on the piston for preventing rotation of the toe housing relative to the piston about the axis, a seal sealingly fixed to the toe housing adjacent the open end of the toe housing and slidably sealingly engaged with the piston, and a fluid inlet communicating with the cavity and adapted to communicate with a supply of fluid under pressure for moving the toe housing relative to the piston.

23. A hydraulic jack comprising a base adapted to be supported by the ground, an elongated piston extending from the base and defining an axis, a generally cylindrical toe housing having a closed end and an open end, the toe housing defining an inner surface surrounding a portion of the piston, the toe housing being movable relative to the piston along the axis, and the toe housing including a toe projecting from the open end of the toe housing, the toe including a lifting surface, supporting means for supporting the toe housing on the piston for movement relative to the piston along the piston axis, the supporting means including interengaging means on the inner surface of the toe housing and the on piston for preventing rotation of the toe housing relative to the piston about the axis, the interengaging means including a keyway in the piston that extends in the direction of the axis and a key that is fixed to the inner surface of the toe housing and that extends into the keyway and a bushing sealingly fixed to the piston and sealingly slidably engaging the inner surface of the toe housing.

24. A hydraulic jack comprising a base adapted to be supported by the ground, an elongated piston defining a piston axis, the piston having a first end fixed to the base, a second end spaced from the base and an outer surface extending between the first and second ends, a portion of the outer surface of the piston being non-circular in a plane perpendicular to the piston axis, a generally cylindrical toe housing having a closed end and an open end, the toe housing defining an inner surface surrounding a portion of the piston, the toe housing being movable relative to the piston along the axis, and the toe housing including a toe projecting from the open end of the toe housing, the toe including a lifting surface, interengaging means on the inner surface of the toe housing and the on piston for preventing rotation of the toe housing relative to the piston about the axis, the interengaging means including a bushing fixed to the toe housing and having therethrough a non-circular bore that slidingly engages the non-circular portion of the outer surface of the piston, and a bushing sealingly fixed to the piston and sealingly slidably engaging the inner surface of the toe housing.

25. A hydraulic jack comprising a base adapted to be supported by the ground, an elongated piston defining a piston axis, the piston having a first end fixed to the base, a second end spaced from the base and an outer surface extending between the first and second ends and being centered on the piston axis, a generally cylindrical toe housing having a closed end and an open end, the toe housing defining an inner surface surrounding a portion of the piston, the inner surface of the toe housing having a first portion that is centered on the piston axis and a second portion that is centered on a second axis offset from the piston axis, the toe housing being movable relative to the piston along the axis, and the toe housing including a toe projecting from the open end of the toe housing, the toe including a lifting surface, and interengaging means on the inner surface of the toe housing and the on piston for preventing rotation of the toe housing relative to the piston about the axis, the interengaging means including a first bushing fixed to first portion of the inner surface of the toe housing and having therethrough a bore that sealingly slidingly engages the piston and a second bushing fixed to the piston and slidably engaging the second portion of the inner surface of the toe housing.

* * * * *